US007134910B2

(12) United States Patent
Nakano et al.

(10) Patent No.: US 7,134,910 B2
(45) Date of Patent: Nov. 14, 2006

(54) CIRCUIT BOARD CONNECTOR

(75) Inventors: Hiroshi Nakano, Yokkaichi (JP); Hiroyoshi Maesoba, Yokkaichi (JP); Kenji Okamura, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/000,864

(22) Filed: Dec. 1, 2004

(65) Prior Publication Data

US 2005/0124228 A1 Jun. 9, 2005

(30) Foreign Application Priority Data

Dec. 3, 2003 (JP) ..... 2003-404637
Dec. 3, 2003 (JP) ..... 2003-404638

(51) Int. Cl.
*H01R 13/60* (2006.01)

(52) U.S. Cl. ..... 439/570

(58) Field of Classification Search ..... 439/570, 439/562, 563, 566, 79
See application file for complete search history.

(56) References Cited

U.S. PATENT DOCUMENTS 4,678,250 A * 7/1987 Romine et al. ..... 439/83
5,186,633 A * 2/1993 Mosser, III ..... 439/79
5,297,966 A * 3/1994 Brennian et al. ..... 439/64
6,089,883 A 7/2000 McHugh et al.
6,254,429 B1 * 7/2001 Morita ..... 439/570
6,305,976 B1 * 10/2001 Tsuji et al. ..... 439/570
7,048,576 B1 * 5/2006 Nakano ..... 439/570
2005/0221666 A1 * 10/2005 Nakano et al. ..... 439/566
2006/0121780 A1 * 6/2006 Nakano ..... 439/570

FOREIGN PATENT DOCUMENTS

EP 0 789 422 A2 8/1997
JP 5-326049 12/1993
JP 6-325826 11/1994

* cited by examiner

*Primary Examiner*—Tulsidas C. Patel
*Assistant Examiner*—Phuongchi Nguyen
(74) *Attorney, Agent, or Firm*—Gerald E. Hespos; Anthony J. Casella

(57) ABSTRACT

A connector has a housing (10) is formed with mount grooves (15) into which board fixing portions (30) made of a metal plate are mountable. Each board fixing portion (30) has main plate (31) and a soldering leg (32) projecting laterally from a bottom portion (35) of the main plate (31). The board fixing portions (30) can be fixed to a circuit board (K) by placing the housing (10) on the circuit board (K) and soldering the soldering portions (32) of the board fixing portions (30) with the board fixing portions (30) mounted in the mount grooves (15).

6 Claims, 16 Drawing Sheets

CIRCUIT BOARD CONNECTOR

BACKGROUND OF THE INVENTION

1. Field of the Invention

The invention relates to a circuit board connector.

2. Description of the Related Art

Japanese Unexamined Patent Publication No. H05-326049 and FIG. 13 herein disclose a circuit board connector. With reference to FIG. 16, the connector has terminal fittings 1 accommodated in a housing 2 that is fixed to a circuit board 3. Board fixing portions 4 are formed integrally at the bottom ends of the opposite side surfaces of the housing 2 and bulge out sideways. Screw holes 5 are formed in the board fixing portions 4 and receive screws 6 for fixing the housing 2 to the circuit board 3. However, the screws 6 bite into the edges of the screw holes 5. As a result, the board fixing portions 4 must be sufficiently large to maintain strength, and hence, there is a tendency to enlarge the entire circuit board connector.

Japanese Unexamined Patent Publication No. H06-325826 discloses another circuit board connector with a housing and a plurality of terminal fittings. Each terminal fitting has a base that is inserted and held in the housing so that the terminal fittings are arranged side-by-side along a width direction of the housing. Portions of the terminal fittings project back from the housing and are bent down. Board connecting portions are defined at bottom ends of the bent portions and are soldered into electrical connection with a circuit board.

A demand exists for a miniature circuit board connector. The connector disclosed in Japanese Unexamined Patent Publication No. H06-325826 could be miniaturized by narrowing the intervals between the terminal fittings along the widthwise direction. This design option would also narrow the intervals between the board connecting portions and would make it difficult to solder the board connecting portions individually to the circuit board.

The present invention was developed in view of the above problems and an object thereof is to miniaturize a circuit board connector.

SUMMARY OF THE INVENTION

The invention relates to a circuit board connector with a housing and a board fixing portion for fixing the housing to a circuit board. The board fixing portion is made of a metal plate and is formed separate from the housing. The board fixing portion is mounted in the housing and is fixed to the circuit board by soldering. The soldered connection enables the board fixing portion to be smaller than the prior art board fixing portion that uses screws to fix the housing to the circuit board. Thus, the entire circuit board connector can be miniaturized.

A solder inflow space preferably is defined between the board fixing portion and the housing for permitting the inflow of solder during soldering. Thus, molten solder is prevented from flowing onto the circuit board even if excess molten solder is used to fix the board fixing portion.

The board fixing portions preferably are coupled side-by-side to a carrier via couplings. The couplings then are cut so that the board fixing portions can be mounted in the respective housing. Each board fixing portion has a soldering portion that can be soldered to the circuit board. The soldering portion preferably is at an end of the board fixing portion different from the end that has the coupling. Thus, any burrs that may be formed during the cutting of the coupling portion will not adversely affect the soldering.

The housing preferably has a mount groove for receiving the board fixing portion. Additionally, the board fixing portion preferably has a retaining portion for biting into an edge of the mount groove and retaining the board fixing portion in the mount groove. The board fixing portion may have a resiliently deformable arm for bringing the retaining portion away from the edge of the mount groove. The resiliently deformable arm reduces the force required to insert the board fixing portion and hence facilitates mounting of the board fixing portion.

The circuit board connector also a plurality of terminal fittings. Each terminal fitting preferably has a base to be held in the housing so that the terminal fittings are arranged substantially side-by-side along a width direction of the housing. A board connecting portion is defined at one end of the base and is connectable with a circuit board. The board connecting portions are narrower than the bases. Thus, the board connecting portions can be connected more easily with the circuit board even if intervals between the respective side-by-side terminal fittings are narrow. Thus, the circuit board connector is suitable for the miniaturization.

Each terminal fitting preferably has a mating portion at an end of the base opposite the board connecting portion. The mating portion projects from a connecting surface of the housing and is connectable with a mating terminal in a mating housing. The bases preferably are wider than the mating portions. Thus, the terminal fittings have suitable strength even though the matting portions are made narrower to conform to mating terminals as a result of the miniaturization.

The terminal fittings preferably are mounted at a plurality of stages along a height direction. The terminal fittings at each stage are at positions displaced from those at each other stage. The board-side connecting portions of the terminal fittings at the respective stages are at substantially the same position along forward and backward directions. Thus, the circuit board connector can be miniaturized along forward and backward directions.

DETAILED DESCRIPTION OF THE PREFERRED EMBODIMENTS

A circuit board connector C according to a first embodiment of the invention is described with reference to FIGS. 1 to 10. As shown in FIGS. 1 to 5, the circuit board connector C has a housing 10. Terminal fittings 20 and board fixing portions 30 are mountable in the housing 10. The housing 10 is fixed to a circuit board K by the board fixing portions 30 and is connectable with an unillustrated mating housing. In the following description, the end of the housing 10 that is to be connected with the mating housing (right side in FIG. 3) is referred to as the front, and reference is made to all the figures except FIGS. 4 and 11 concerning the vertical direction.

Figure 1:
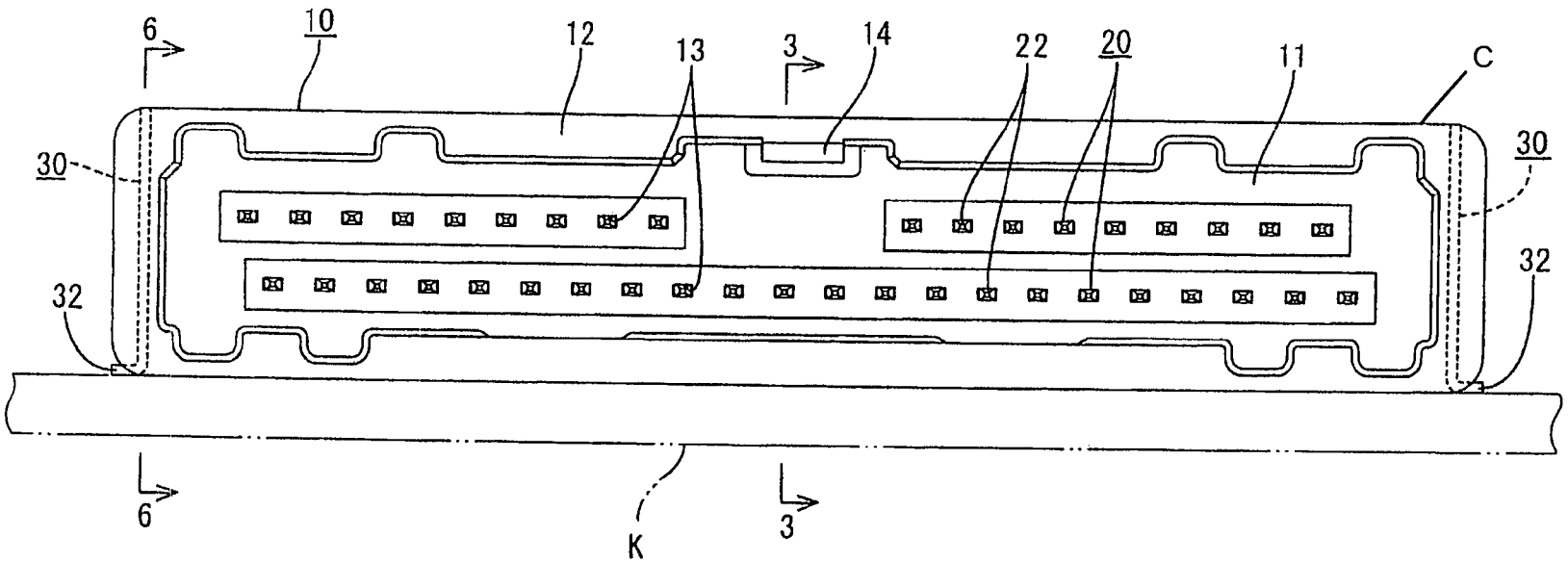
FIG. 1 is a front view of a circuit board connector according to a first embodiment of the invention.
Figure 2:
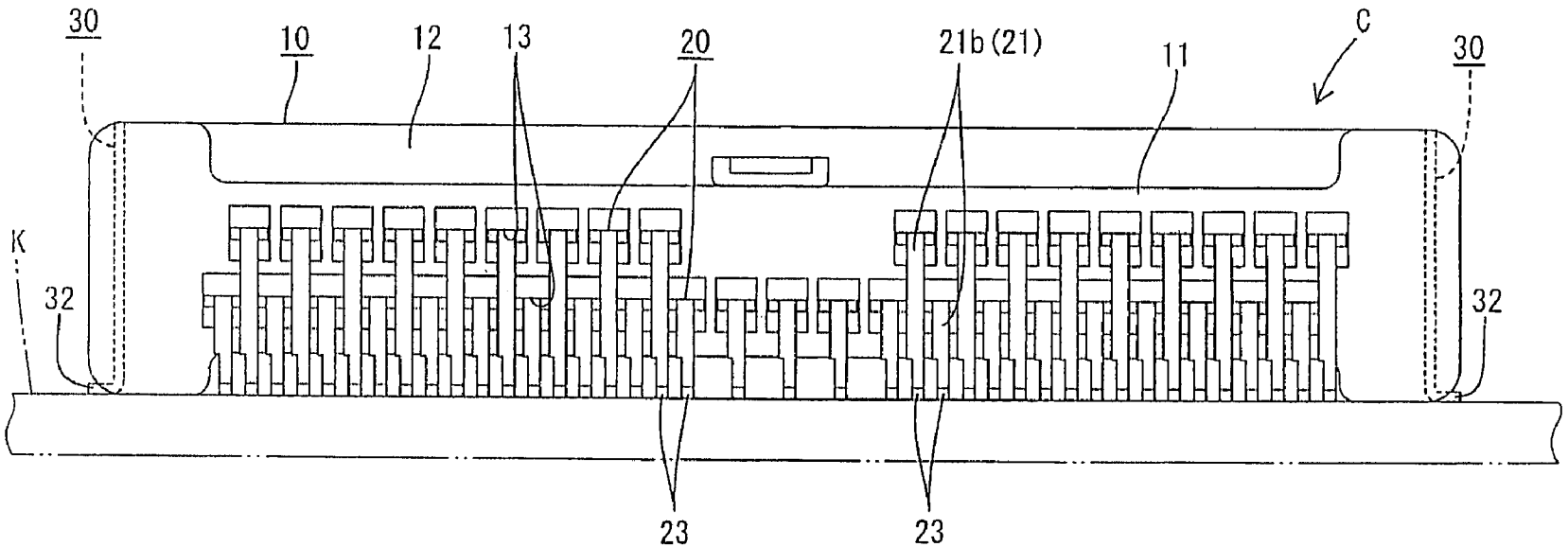
FIG. 2 is a rear view of the circuit board connector.
Figure 3:
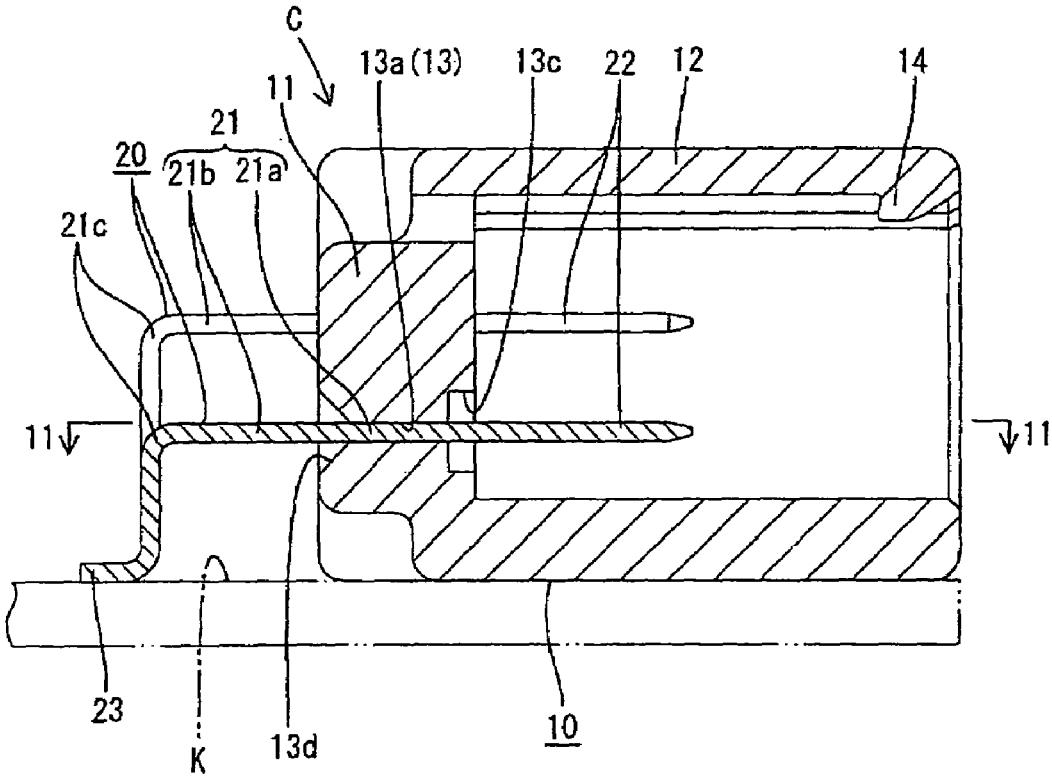
FIG. 3 is a section along 3—3 of FIG. 1.
Figure 4:
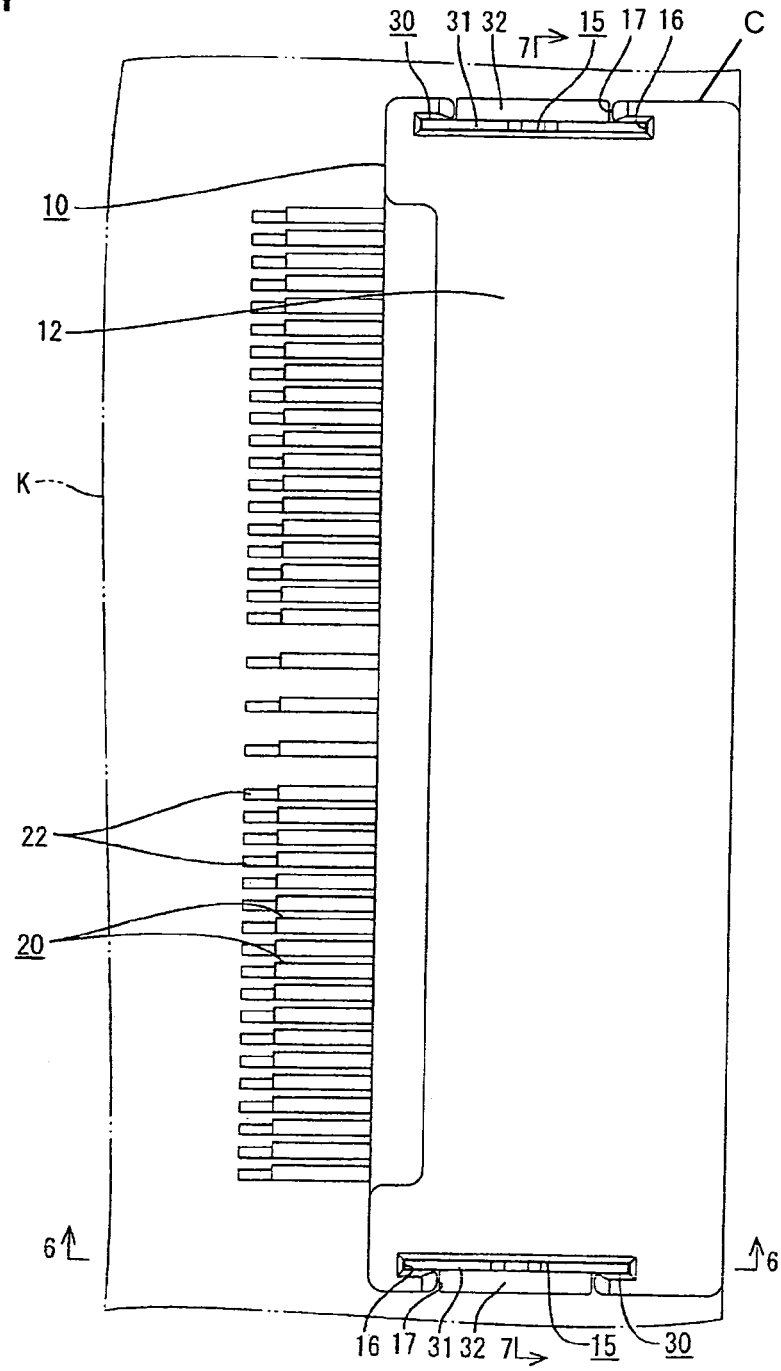
FIG. 4 is a plan view of the circuit board connector.

As shown in FIGS. 1 to 3, the housing 10 has a wide terminal holding portion 11 and a receptacle 12 that projects forward from a peripheral edge of the terminal holding portion 11. The terminal holding portion 11 is formed with a plurality of terminal insertion holes 13 for receiving the terminal fittings 20. The terminal insertion holes 13 are arranged side-by-side along a width direction at upper and lower stages. More specifically, twenty-two terminal insertion holes 13 are arranged at the lower stage and eighteen terminal insertion holes 13 are arranged at the upper stage. The upper stage is divided into left and right arrays of nine terminal insertion holes, as shown in FIG. 1.

Figure 5:
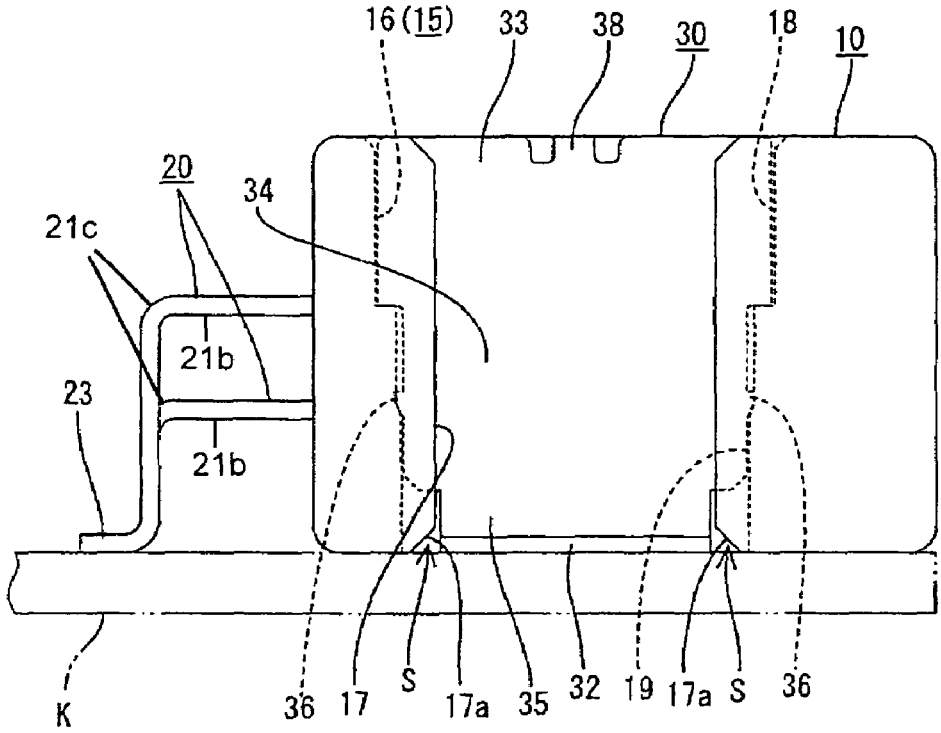
FIG. 5 is a side view of the circuit board connector.
Figure 11:
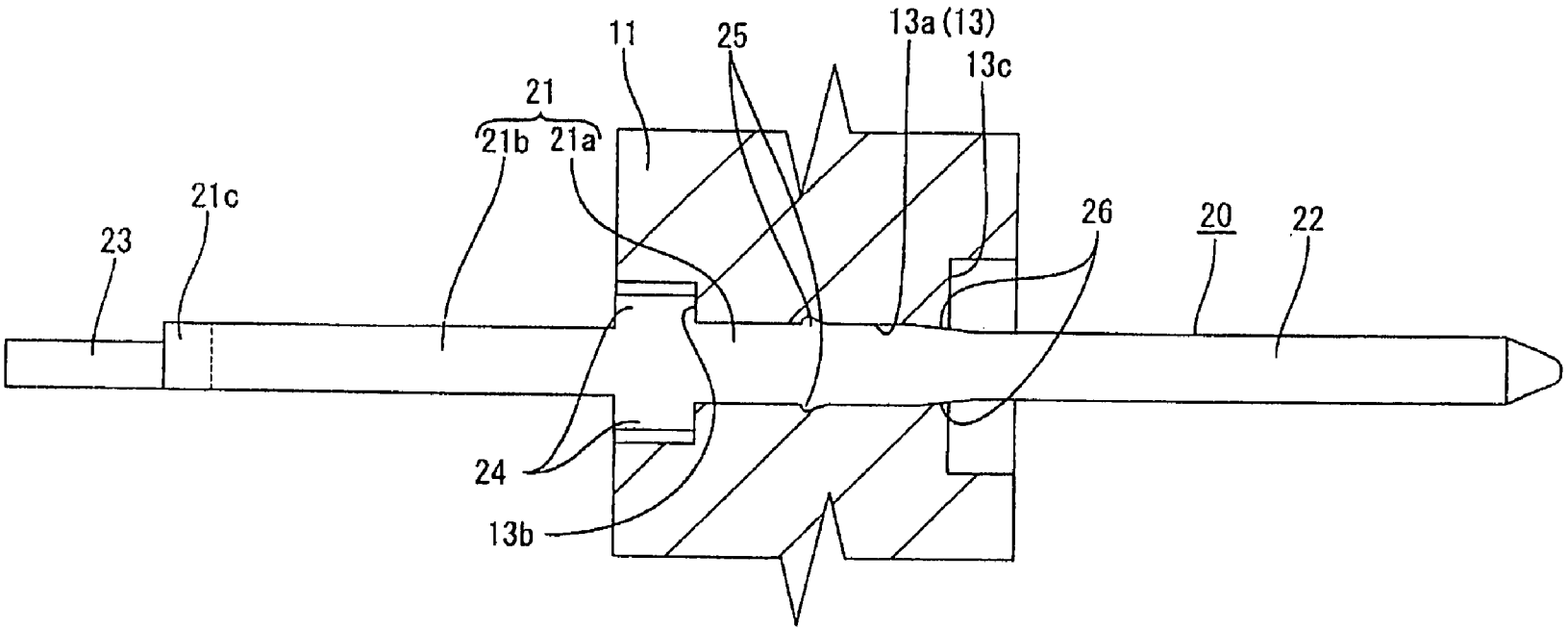
FIG. 11 is an enlarged section along 11—11 of FIG. 3.

As shown in FIG. 11, each terminal insertion hole 13 has an intermediate portion 13*a* between the front and rear ends. A receiving portion 13*b* is defined adjacent the rear end of the terminal insertion hole 13 and an escaping portion 13*c* is defined adjacent the front end. The receiving portion 13*b* and the escaping portion 13*c* are wider than the intermediate portion 13*a*. Slanted surfaces 13*d* are defined on the upper and lower surfaces of the rear end of each terminal insertion hole 13, as shown in FIG. 5, for guiding the insertion of the terminal fitting 20.

The receptacle 12 is a substantially rectangular tube with an open front end for receiving the mating housing from the front. A lock 14 projects down and in at a widthwise middle position of the upper part of the receptacle 12. The lock 14 is engageable with a lock arm of the mating housing to hold the two housings connected. A mount groove 15 is provided at each of the opposite widthwise sides of the receptacle 12 for receiving the board fixing portions 30.

Each board fixing portion 30 is made separate from the housing 10 and is formed by bending a metal plate that has been stamped into a specific shape, as shown in FIGS. 4 to 7. The board fixing portion 30 has a substantially flat main plate 31 that extends along the vertical direction. A soldering leg 32 projects laterally from a bottom end 35 of the main plate 31. Thus, the board fixing portion 30 is substantially L-shaped when viewed from the front or behind (see FIG. 7). The board fixing portion 30 is mountable into the mount groove 15. Accordingly, the mount groove 15 has a main plate accommodating section 16 into which the main plate 31 is insertable along a direction defined by its plate surface. The mount groove 15 also has a soldering leg accommodating section 17 into which the soldering leg 32 is insertable along a direction normal to a direction of its plate surface.

Figure 6:
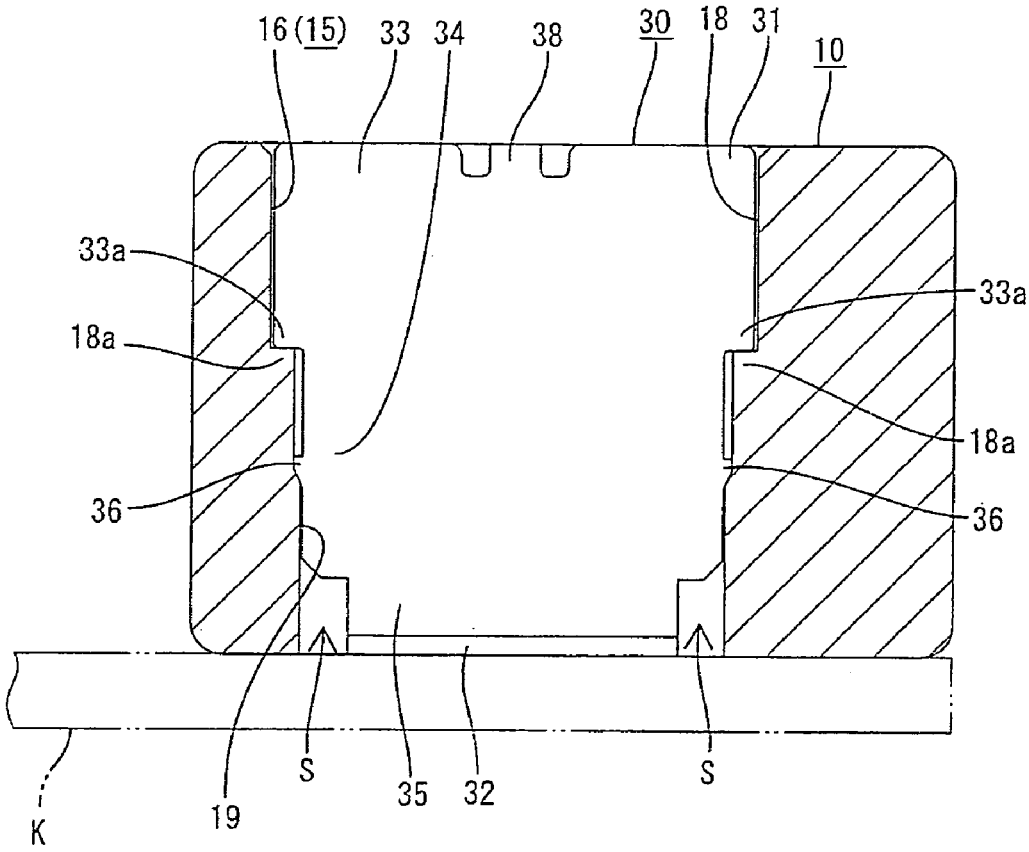
FIG. 6 is a section along 6—6 of FIGS. 1 and 4.

The main plate 31 of the board fixing portion 30 is stepped to define three widths that become sequentially narrower towards the bottom end, as shown in FIG. 6. More particularly, the main plate 31 has a wide upper portion 33, a middle portion 34 of intermediate width and a narrow bottom portion 35. A step 33*a* is defined at the bottom end of the upper portion 33 of the main plate 31 The soldering leg 32 has substantially the same width as the bottom portion 35 to which the soldering leg 32 is coupled. On the other hand, the main plate accommodating section 16 of the mount groove 15 has a wide portion 18 and a narrow portion 19 adjacent to and below the wide portion 18. A step 18*a* is defined at the bottom end of the wide portion 18 of the main plate accommodating section 16. The wide portion 18 has a width substantially equal to or larger than the width of the upper portion 33 of the main plate 31 and the narrow portion 19 has a width substantially equal to or larger than the width of the middle portion 34 of the main plate 31. The soldering leg accommodating portion 17 has a width substantially equal to or larger than the widths of the bottom section 35 of the main plate 31 and the soldering leg 32.

The board fixing portion 30 is inserted into the mount groove 15 until the step 33*a* at the bottom end of the upper portion 33 of the main plate 31 contacts the step 18*a* at the bottom end of the wide portion 18 of the main plate accommodating portion 16. Thus, the bottom surface of the board fixing portion 30 is positioned to be substantially flush with the bottom surface of the housing 10. The bottom portion 35 of the main plate 31 is spaced from the narrow portion 19 of the main plate accommodating portion 16 by specified clearances to define solder inflow spaces S when the board fixing portion 30 is mounted in the mount groove 15. The solder inflow spaces S are exposed laterally to the outside to permit the flow of the solder during a soldering operation. Notches 17*a* are formed at the bottom ends of the groove edges of the soldering leg accommodating portion 17 to facilitate the inflow of the solder (see FIG. 5). Retaining projections 36 project laterally from the opposite side edges of the middle portion 34 of the main plate 31. The retaining projections 36 bite into the groove edges of the narrower portion 19 of the main plate accommodating portion 16 to retain the board fixing portion 30 in the mount groove 15. A projecting distance of the soldering leg 32 substantially equals the depth of the soldering leg accommodating portion 17. Thus, the projecting end of the soldering leg 32 is substantially flush with the outer side surface of the housing 10 with the board fixing portion 30 mounted in the mount groove 15.

Figure 8:
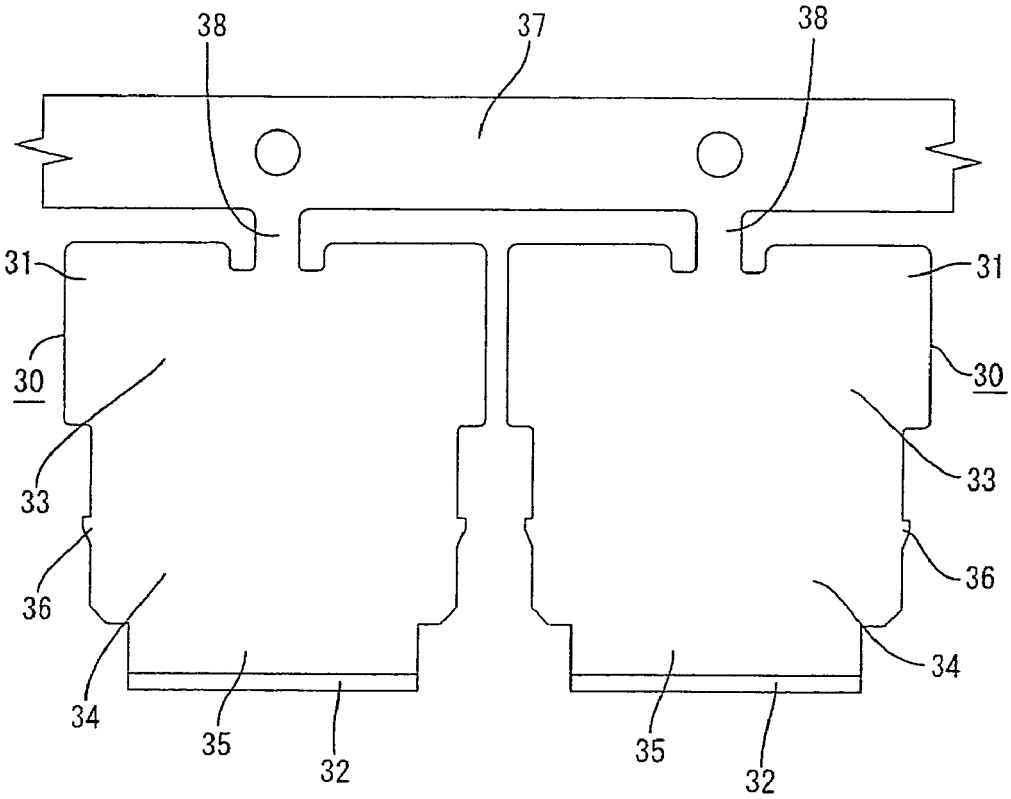
FIG. 8 is a side view showing board fixing portions coupled to a carrier.

Many board fixing portions 30 are stamped from a metal blank to project side-by-side from a carrier 37 that extends in the widthwise direction of the board fixing portions 30, as shown in FIG. 8. More specifically, the chained board fixing portions 30 are coupled to the carrier 37 via couplings 38 formed at the upper ends of the main plates 31 and hence opposite from the soldering legs 32. The couplings 38 are cut substantially at the upper ends of the metal plates 31 to separate the board fixing portions 30 from the carrier 37.

Each terminal fitting 20 is formed by bending a metal plate that has been stamped into a specified shape. As shown in FIG. 3, each terminal fitting 20 includes a base 21 held in the terminal holding portion 11 of the housing 10. A rear part 21*b* of the base 21 projects back from the terminal holding portion 11 and is bent down to define a substantially L-shape. A front part 21*a* of the base 21 is inserted into the terminal insertion hole 13 and is slightly wider than the intermediate portion 13*a* of the terminal insertion hole 13. Thus, the base 21 is pressed into the terminal insertion hole 13. On the other hand, the rear part 21*b* of the base 21 that projects back from the terminal holding portion 11 is narrower than the front part 21*a* and the intermediate portion 13*a* of the terminal insertion hole 13.

A mating portion 22 is provided at a front side of the base 21 of the terminal fitting 20 and projects forward from the front connecting surface of the terminal holding portion 11. The mating portion 22 is surrounded by the receptacle 12 and is connected electrically with a mating terminal in a mating housing. On the other hand, a board connecting portion 23 is at the bottom end of the base 21 and is bent to extend back. The board connecting portion 23 is electrically connectable with a conductor path (not shown) printed on the circuit board K by soldering. The thickness of each terminal fitting 20 is constant over the entire length, and the width of the base 21 exceeds the thickness thereof.

Two front-stops 24 bulge out sideways at the opposite lateral edges of the rear end of the front part 21*a* of the base 21. The front end surfaces of the front-stops 24 contact the rear end surface of the receiving portion 13*b* when the terminal fitting 20 is inserted to a proper depth in the terminal insertion hole 13. Thus, the terminal fitting 20 can be stopped so as not to move any further forward from a proper insertion position. Two retaining portions 25 project sideways on the opposite lateral edges of the front part 21*a* of the base 21 before the front-stops 24 and bite into the edges of the terminal insertion hole 13 for retaining the terminal fitting 20 in the terminal insertion hole 13.

As shown in FIGS. 2, 3 and 11, the board connecting portion 23 is narrower than the rear part 21*b* of the base 21. More specifically, the width of the board connecting portion 23 is substantially equal to the thickness of the terminal fitting 20. The lower surface of the board connecting portion 23 in FIG. 3 is substantially flush with the lower surface of the rear part 21*b* of the base 21, whereas the upper surface thereof in FIG. 3 is lower than the upper surface of the rear part 21*b*. Accordingly, intervals between adjacent board connecting portions 23 along the width direction are sums of the intervals between the rear parts 21*b* of the adjacent base 21 and a difference between the width of the rear parts 21*b* of the bases 21 and that of the board connecting portions 23.

The matting portion 22 is narrower than the front part 21*a* of the base 21, but is wider than the board connecting portion 23. A boundary between the matting portion 22 and the base 21 is gradually widened toward the base 21, and the opposite side surfaces thereof define slanted insertion guides 26 that guide the insertion of the terminal fitting 20 into the terminal insertion hole 13.

As described above, the terminal insertion holes 13 are offset. Accordingly, the terminal fittings 20 at the upper stage and those at the lower stages are offset along the width direction as shown in FIGS. 2 and 3. Additionally, the rear ends of the board connecting portions 23 of the terminal fittings 20 at the upper and lower stages are at substantially the same position along forward and backward directions.

The terminal fittings 20 are obtained by stamping a metal plate into a specified shape, and then bending and embossing the plate. Here, depending on the metal plate used, the width may be smaller than the thickness. In such a case, the entire terminal fitting 20 is elongated widthwise by embossing to obtain a planned width and thickness for each part. The base 21 then is bent substantially at a right angle to form a bend 21*c*. The bending is applied after the thickness is made smaller than the width. Thus, the bending precision is improved, and the bent portion 21*c* is formed reliably into a planned shape.

Figure 12:
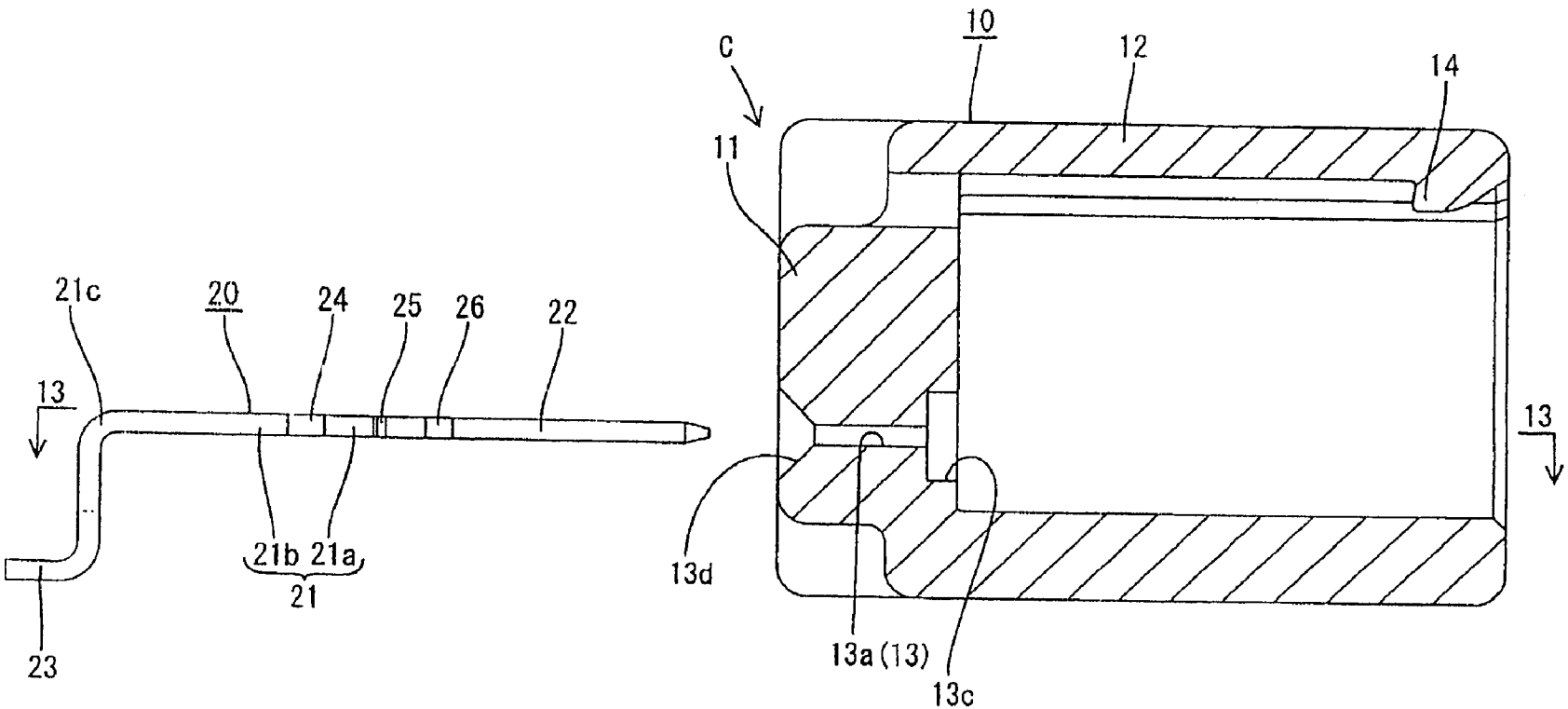
FIG. 12 is a section similar to FIG. 3, but showing a state before the terminal fittings are inserted.
Figure 13:
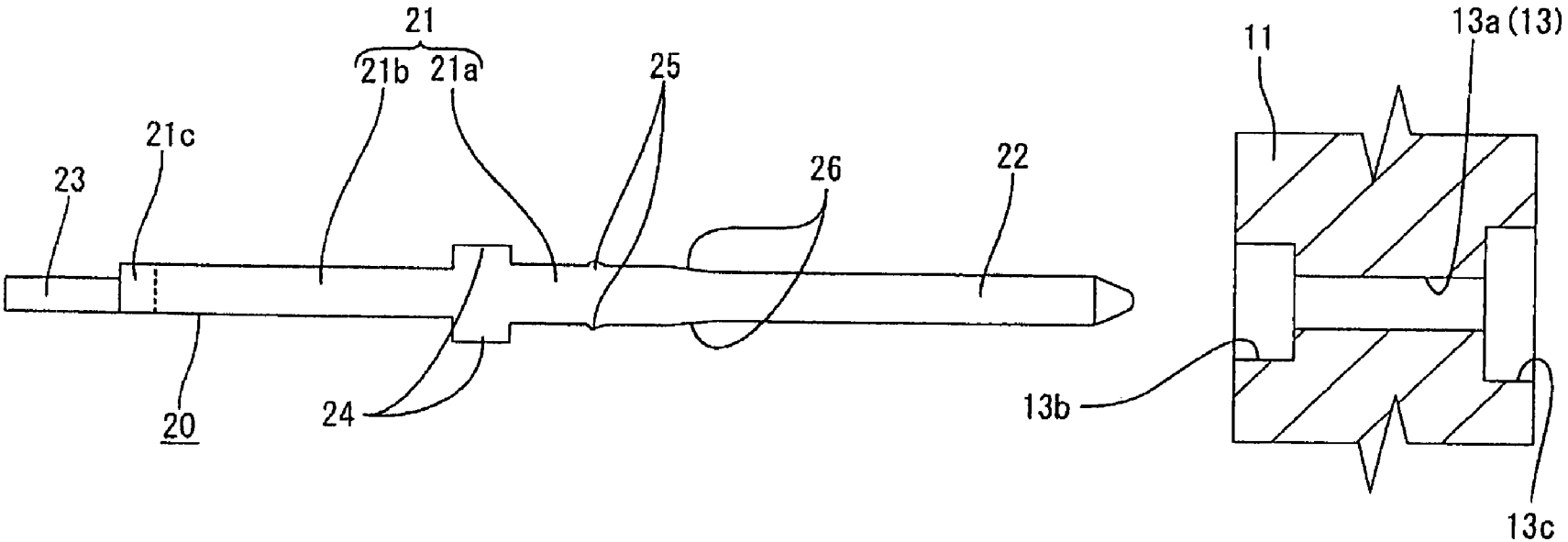
FIG. 13 is an enlarged section along 13—13 of FIG. 12 showing the state before the terminal fittings are inserted.

The connector C is assembled by inserting the terminal fittings 20 are into the housing 10 from a state shown in FIGS. 12 and 13. More particularly, the terminal fitting 20 is inserted into the terminal insertion hole 13 from the front end of the matting portion 22. The base 21 enters the intermediate portion 13*a* of the terminal insertion hole 13 when the terminal fitting 20 reaches a specified depth. The base 21 is wider than the intermediate portion 13*a*, thereby increasing insertion resistance. The insertion guiding surfaces 26 gradually bite into the edges of the terminal insertion hole 13 and the insertion resistance increases gradually. Thus, the insertion is carried out smoothly. In this process, the retaining portions 25 bite in the edges of the terminal insertion hole 13 and the front-stops 24 enter the receiving portion 13*b*. The front end surfaces of the front-stops 24 contact the rear end surface of the receiving portion 13*b* when the terminal fitting 20 reaches the proper depth, as shown in FIGS. 3 and 11. Thus, further insertion of the terminal fitting 20 is prevented. In this state, the retaining portions 25 bite in the edges of the terminal insertion hole 13 to retain the terminal fitting 20 in the terminal insertion hole 13. It should be noted that only the terminal fitting 20 to be arranged at the lower stage is shown in FIG. 12.

Figure 7:
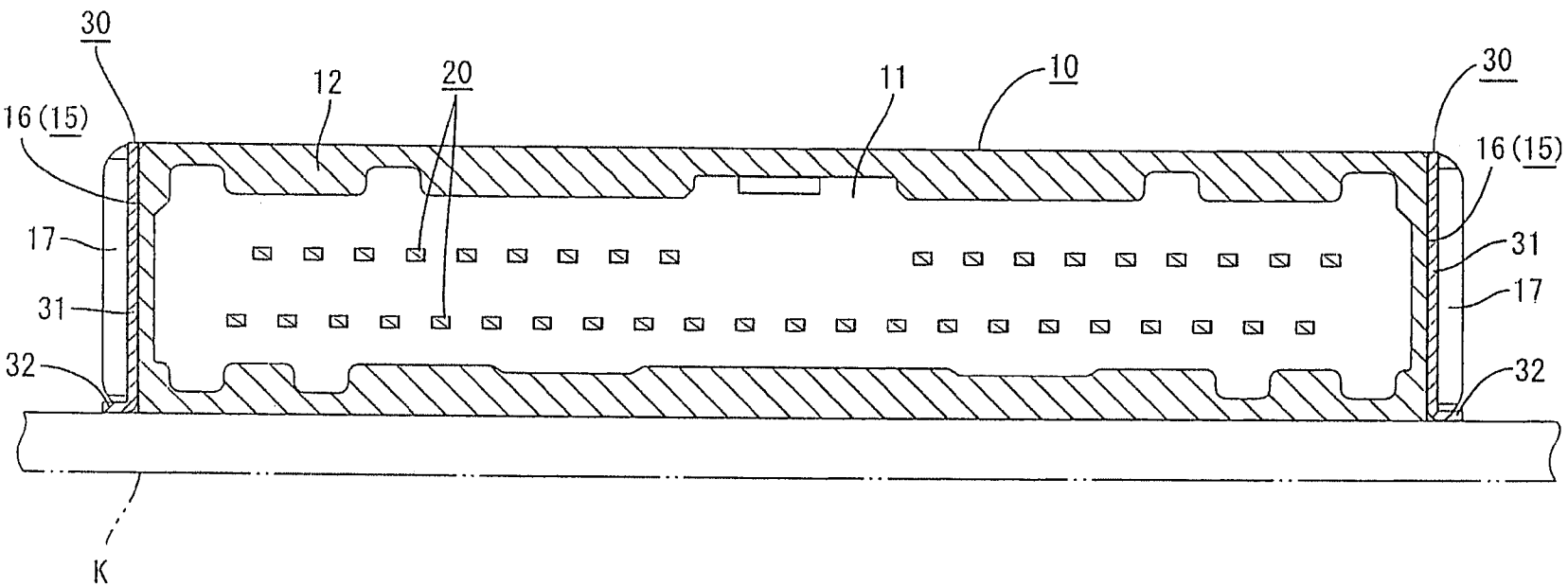
FIG. 7 is a section along 7—7 of FIG. 4.
Figure 9:
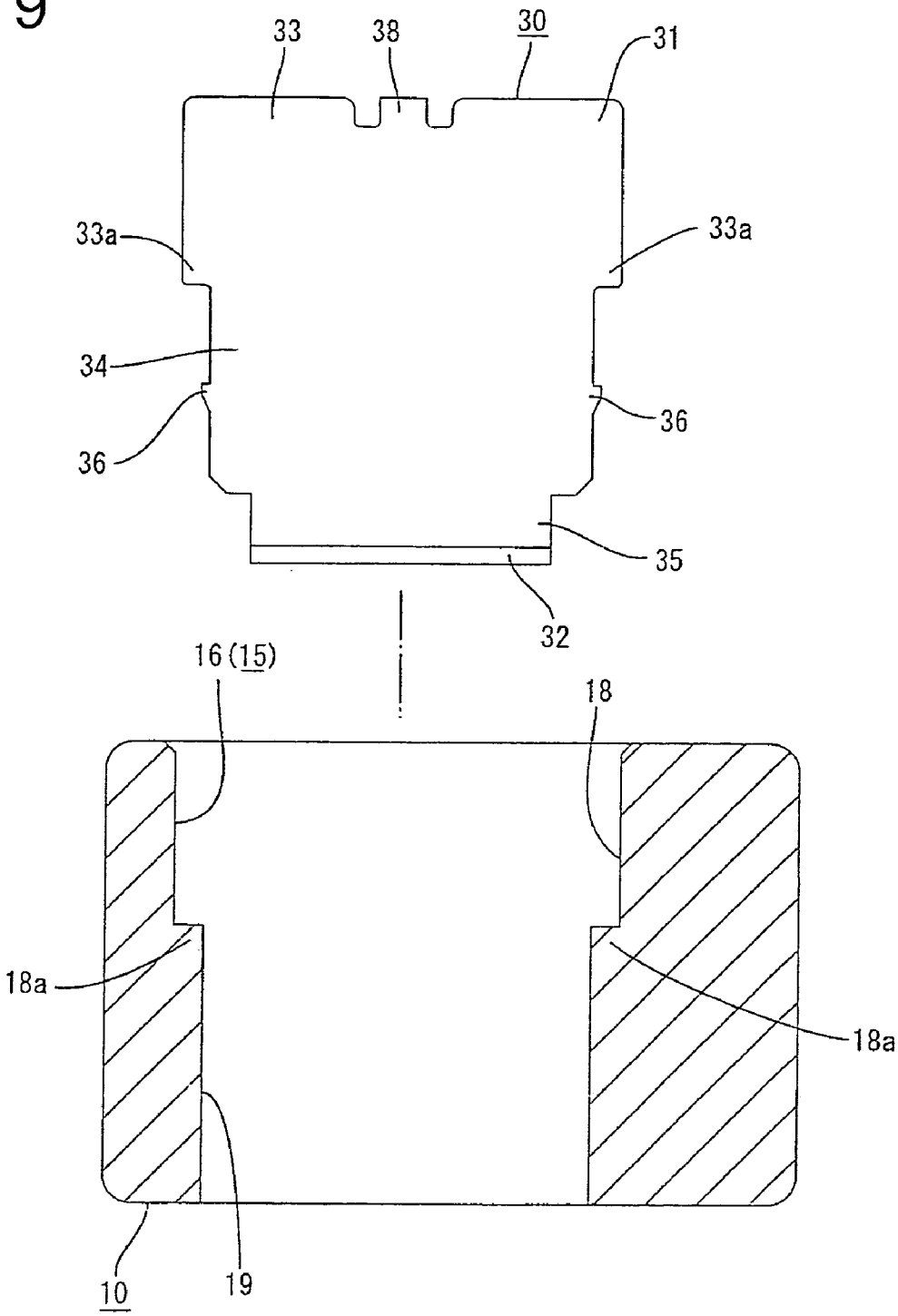
FIG. 9 is a section similar to FIG. 6, but showing a state before the board fixing portions are inserted into mount grooves.
Figure 10:
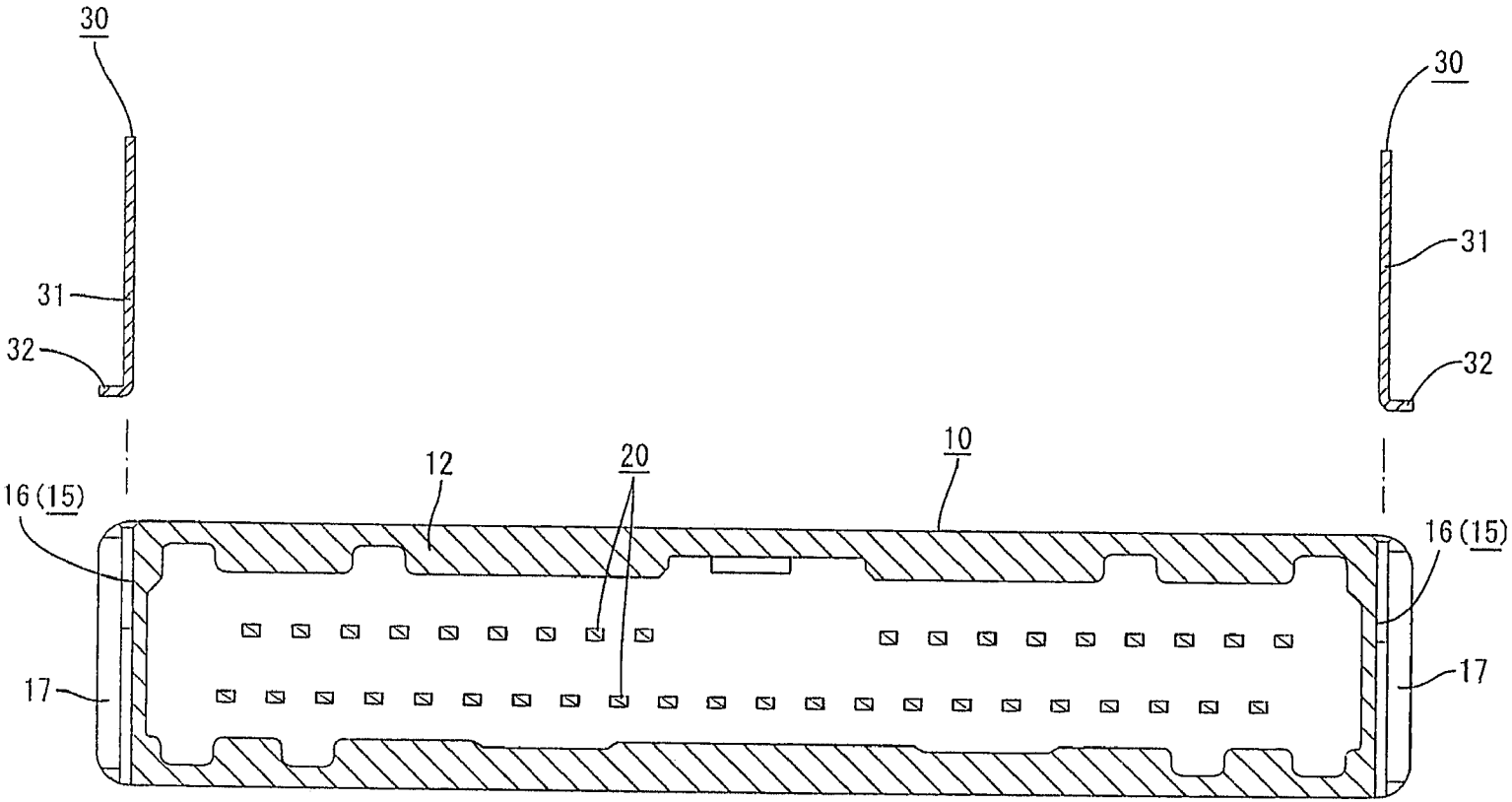
FIG. 10 is a section similar to FIG. 7, but showing the state before the board fixing portions are inserted into the mount grooves.

The connector assembly proceeds by inserting the board fixing portions 30 into the mount grooves 15 from above along the direction of the plate surfaces of the main plates 31 from a state shown in FIGS. 9 and 10. Thus, the main plates 31 and the soldering legs 32 enter the main plate accommodating portions 16 and the soldering leg accommodating portions 17, respectively. The mounting operation of the board fixing portions 30 is carried out by pushing an unillustrated jig against the upper ends (ends toward the couplings 38) of the main portions 31. The middle portion 34 of the main plate 31 moves down into the narrow portion 19 of the mount groove 15. As a result, the retaining projections 36 bite into the groove edges of the narrow portion 19. Simultaneously, the upper portion 33 of the main plate 31 enters the wide portion 18 of the mount groove 15. The steps 33*a* of the upper portion 33 then contact the steps 18*a* of the wide portion 18, as shown in FIGS. 6 and 7, to prevent further insertion of the board fixing portions 30. In this state, the bottom end surfaces of the main plate 31 and the soldering leg 32 are substantially flush with the bottom end surface of the housing 10. Further, in this state, the retaining projections 36 bite in the groove edges of the narrow portions 19 to prevent the board fixing portions 30 from coming upward out of the mount grooves 15.

The terminal fittings 20 may be mounted before or after the board fixing portions 30.

The housing 10 is placed on the circuit board K so that the soldering legs 32 of both board fixing portions 30 are at specified positions on the circuit board K. Molten solder then is attached to the peripheral edges of the soldering legs 32. The amount of the molten solder may be excessive. However, excess solder flows into the solder inflow spaces S between the bottom portion 35 of the main plate 31 and the narrow portion 19 of the main plate accommodating portion 16 to prevent molten solder from flowing onto the circuit board K. The board fixing portions 30 are fixed to the circuit board K by solidifying the attached solder.

The board connecting portions 22 of the terminal fittings 20 are laid on the corresponding conductor paths on the circuit board K, and molten solder is attached to peripheral edges of the board connecting portions 22. The molten solder is solidified so that the board connecting portions 22 are fixed to the circuit board K and are connected electrically with the conductor paths. The board fixing portions 30 can be fixed to the circuit board K before or after the terminal fittings 20 are soldered.

The mating housing is fit into the receptacle 12 after the circuit board connector C is mounted on the circuit board K as described above. Then, mating terminals are connected electrically with the matting portions 22.

As described above, the metal board fixing portions 30 are mounted into the housing 10 and are fixed to the circuit board K by soldering. Thus, the board fixing portions 30 are smaller than the prior art board fixing portions that must be fixed by screws, and the entire circuit board connector can be miniaturized. Further, the operation of fixing the board fixing portions 30 and the operation of soldering the terminal fittings 20 can be carried out successively, and the prior art process of tightening screws is not needed. Thus, operational efficiency is better.

The solder inflow spaces S are defined between the board fixing portions 30 and the housing 10. Excess solder applied during soldering the board fixing portions 30 will flow into the solder inflow spaces S and not onto the circuit board K.

The soldering leg 32 is provided at the end of the board fixing portion 30 spaced from the end that has the coupling 38. Thus, any burrs formed as the coupling 38 is cut will not adversely affecting the soldering.

The terminal fittings 20 at the upper and lower stages are offset along the width direction and the board connecting portions 22 of the terminal fittings 20 at the upper and lower stages are at substantially the same position with respect to forward and backward directions. Accordingly, the circuit board connector C is small along forward and backward directions as compared to circuit board connectors that have the board connecting portions of terminal fittings at upper and lower stages offset along forward and backward directions.

The board connecting portions 23 of the terminal fittings 20 are narrower than the bases 21. Thus, sufficient intervals are given between adjacent board connecting portions 23, even if the widthwise intervals between the respective terminal fittings 20 are smaller due to miniaturization of the circuit board connector. C and the offset arrangement of the terminal fittings 20. As a result, the board connecting portions 23 can be soldered easily to the circuit board K, and the circuit board connector C is suitable for the miniaturization.

The bases 21 are wider than the matting portions 22. Thus, the terminal fittings 20 have a suitable strength even if the width of the mating portions 22 are reduced to conform to mating terminals as a result of the miniaturization of the connector. Furthermore, the terminal fittings 20 at the upper and lower stages are displaced along the width direction. Thus, the rear ends of the connector-side connecting portions 23 of the terminal fittings 20 at the upper and lower stages are at substantially the same position along forward and backward directions. Therefore, the circuit board connector C can be made smaller along forward and backward directions.

A second embodiment of the invention is described with reference to FIGS. 14 and 15. Elements of the second embodiment that are the same as or similar to the first embodiment are identified by the same reference numerals but are not described again.

Figure 14:
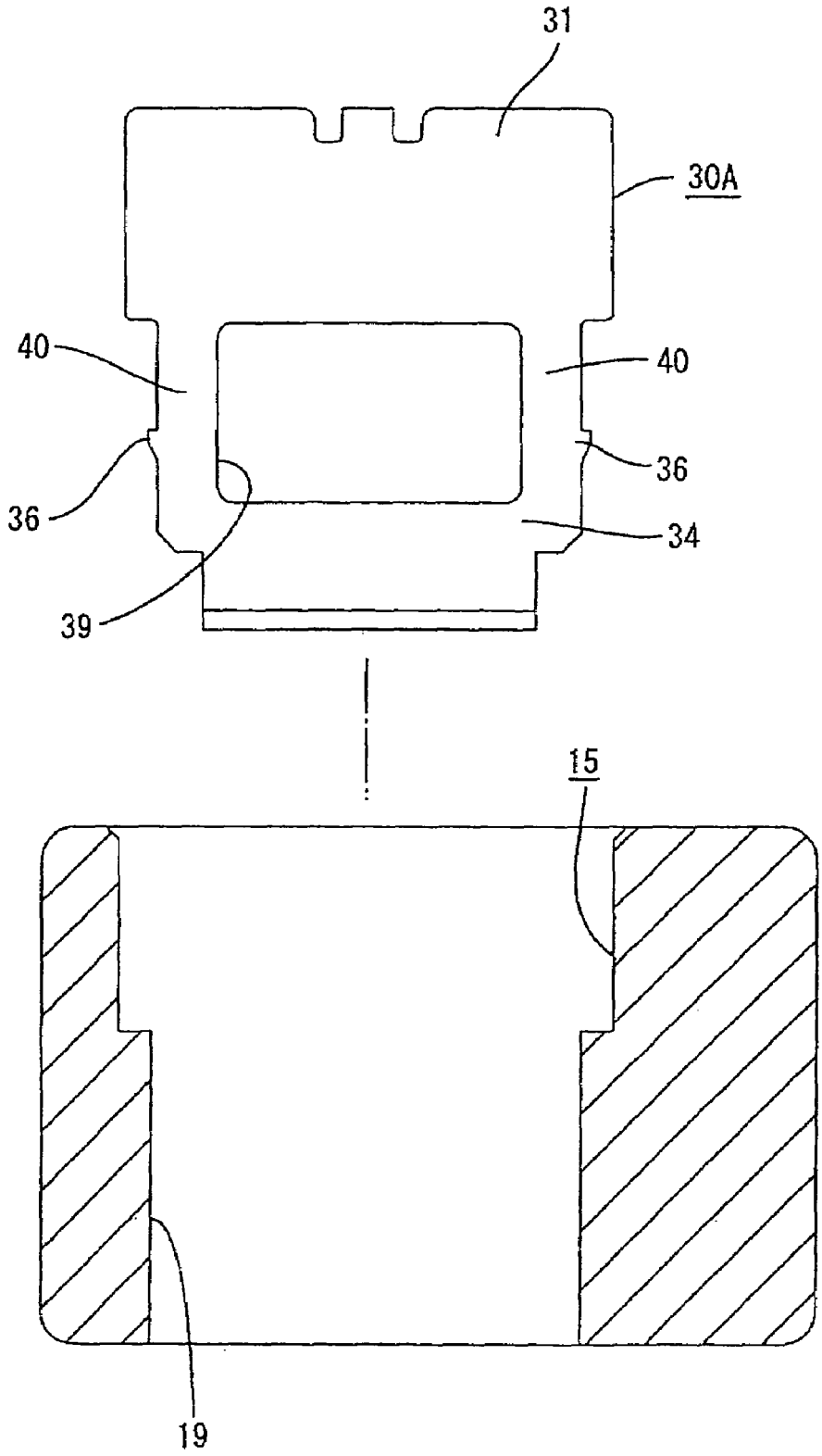
FIG. 14 is a section similar to FIG. 9, but showing a state before a board fixing portion according to a second embodiment of the invention is inserted into a mount groove.
Figure 15:
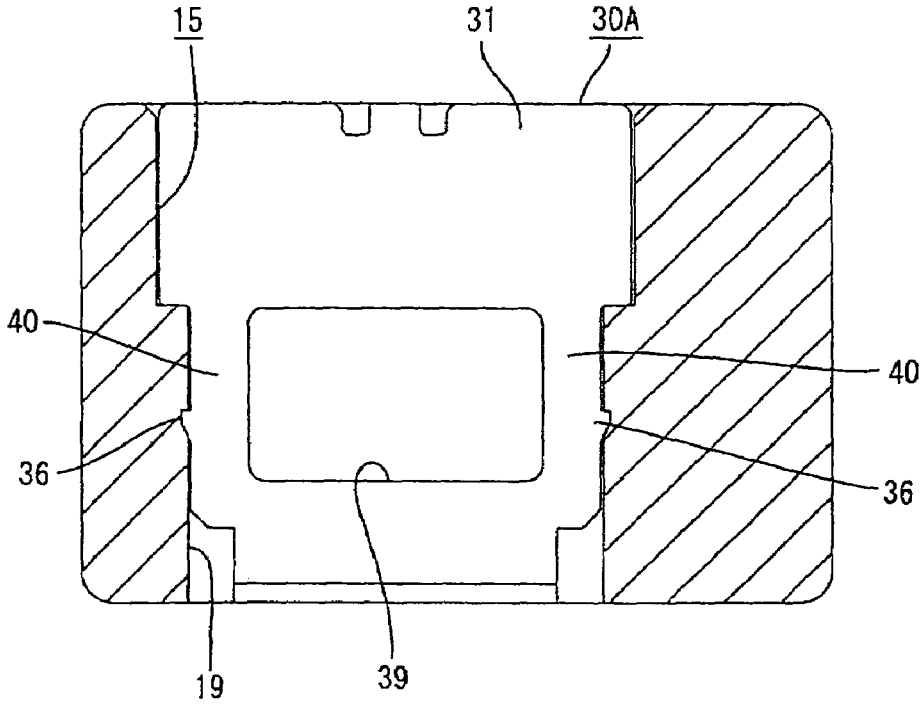
FIG. 15 is a section similar to FIG. 14, but showing a state where the alternate board fixing portion is mounted.
Figure 16:
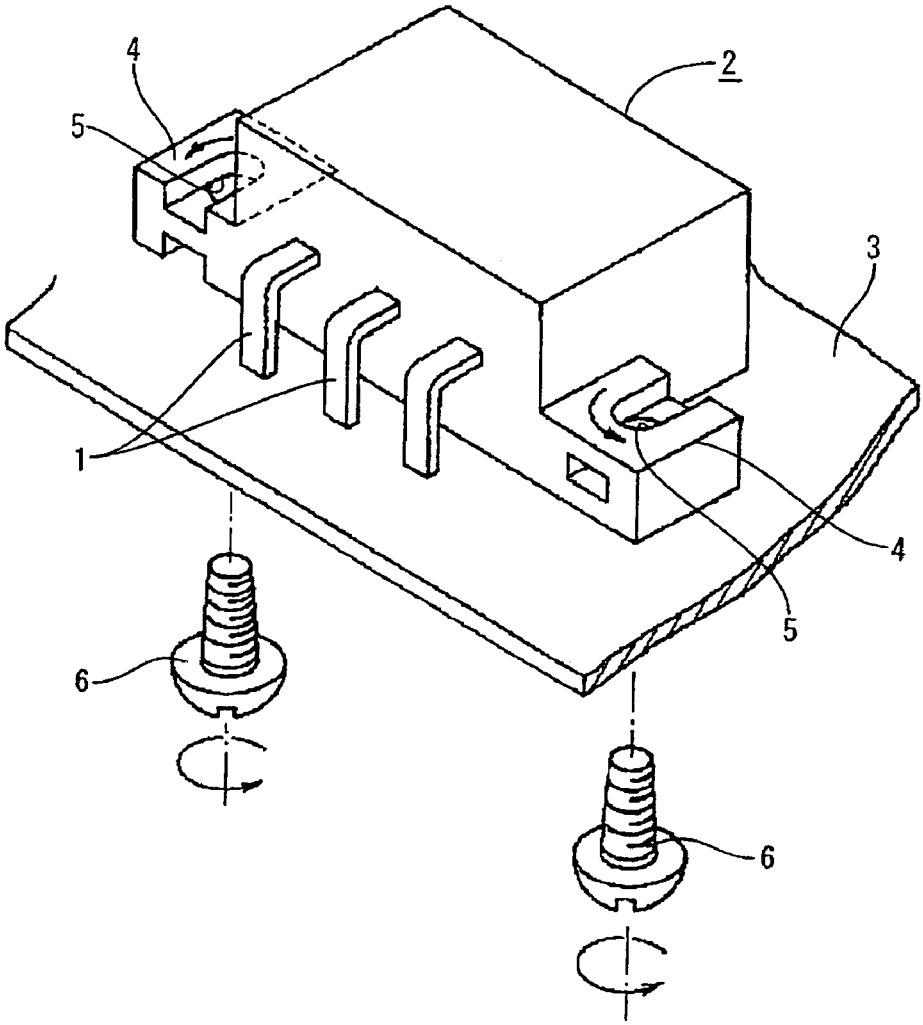
FIG. 16 is a perspective view of a prior art circuit board connector.

The circuit board connector of the second embodiment has a board fixing portion 30A with a main plate 31, as shown in FIG. 14. A substantially rectangular bore 39 is formed in the middle portion 34 of the main plate 31 and defines arms 40 at the opposite sides of the middle portion 34. Each arm 40 is supported at its opposite ends and is resiliently deformable inward. A retaining projection 36 is formed on the outer side edge of each arm 40. The retaining projections 36 contact the groove edges as the board fixing portion 30A is inserted into the mount groove 15. Accordingly, the arms 40 deform resiliently inward and away from the groove edges of the narrow portion 19. Biting movements of the retaining projections 36 are alleviated, and a force required to insert the board fixing portion 30A is smaller as compared to the first embodiment. Thus, the board fixing portion 30A can be inserted without using a jig, thereby improving operational efficiency. The retaining portions 36 bite in the groove edges of the narrow portions 19 to retain the board fixing portion 30A in the mount groove 15, as shown in FIG. 15, when the board fixing portion 30A is inserted up to a proper depth.

The invention is not limited to the above described and illustrated embodiments. For example, the following embodiment is also embraced by the technical scope of the present invention as defined by the claims. Beside the following embodiment, various changes can be made without departing from the scope and spirit of the present invention as defined by the claims.

The shape of the board fixing portion can be changed. For example, the board fixing portion of the first embodiment may be formed with such a bored portion as not to form arms.

The housing may be formed with positioning projections and the circuit board may be formed with positioning recesses, so that the positioning projections fit in the positioning recesses to locate the soldering portions of both board fixing portions at positions on the circuit board planned to fix the board fixing portions to the circuit board and to position the board connecting portions of the respective terminal fittings on the corresponding conductor paths.

The solder inflow spaces are defined by forming the bottom of the main plate of the board fixing portion narrower than the middle portion in the foregoing embodiments. However, the solder inflow spaces may be defined, for example, by forming the middle and bottom portions of the main plate to have the same width and forming the bottom end of the narrower portion of the mount groove to be partly wider.

The coupling is at the upper end of the main plate opposite from the soldering leg in the foregoing embodiments. However, the coupling may be at a lateral end of the main plate or at the bottom end of the main portion.

The arms of the second embodiment may be supported only at one end according to the present invention.

The terminal fittings are connected to the circuit board by soldering in the foregoing embodiments. However, the invention also is applicable to connectors with press-fit terminals in which board connecting portions are pressed into a circuit board. Further, the terminal fittings are not limited to an L-shape and the invention is applicable to connectors with straight terminal fittings. The invention is also applicable to cases where male terminal fittings are mounted in a mating housing and terminal fittings have female connector connecting portions.

The width of the base exceeds its thickness in the foregoing embodiment. However, the thickness may equal or exceed the width according to the invention. The width and thickness of the mating portions and those of the board connecting portions also can be changed. In such a case, the mating portions may have the same width as the bases.

Although the terminal fittings are offset in the foregoing embodiment, the upper and lower terminal fittings may be at the same width positions.

What is claimed is:

1. A circuit board connector, comprising:

a housing having a top surface, a board mounting surface opposite the top surface and first and second side surfaces extending from the board mounting surface, mount grooves formed respectively in the side surfaces of the housing and extending from the top surface to the board mounting surface of the housing, each of the mounting grooves having a wide portion substantially adjacent the top surface of the housing and a narrow portion extending from the wide portion to the board mounting surface of the housing; and a first and second board fixing portions made of a metal plate separate from the housing, each of the board fixing portions having a main plate mounted in the mount groove of the housing, the main plate having opposite top and bottom ends, an upper portion of the main plate being dimensioned for slidable insertion into the wide portion of the respective mount groove in the housing, the main plate further having a middle portion adjacent the upper portion and being dimensioned for slidable insertion into the narrow portion of the respective mount groove, retaining projections extending out from opposite sides of the middle portion main plate and dimensioned to bite into and engage portions of the housing adjacent the respective mount groove, the main plate further having a lower portion adjacent the bottom end of the main plate and being narrower than the middle portion to define solder inflow spaces, the board fixing portion further having a solder leg extending substantially perpendicularly from the bottom end of the main plate, the solder leg having a surface substantially flush with the board mounting surface and having a free end spaced from the main plate and aligned substantially flush with portions of the side surface of the housing adjacent the mount groove, such that the board fixing portion is configured for being soldered to a circuit board without extending beyond the side surface of the housing.

2. The circuit board connector of claim 1, wherein the housing includes a plurality of cavities for receiving terminal fittings, the board fixing portion being spaced from the cavities.

3. The circuit board connector of claim 1, wherein the board fixing portion comprises at least one resiliently deformable arm disposed for deflecting away from the edge of the mount groove, the retaining projection being formed on the arm.

4. The circuit board connector of claim 1, wherein each of said mounting grooves has steps between the wide portion and the narrower portion, each of said main plates having steps between the upper portion and the middle portion, the steps of the main plate engaging the steps of the mounting groove to position the respective board fixing portion relative to the board mounting surface.

5. A circuit board connector, comprising:

a housing formed from a resin material, the housing having a top surface and a board-mounting surface opposite the top surface for placement on a circuit board, a plurality of cavities extending through the housing and first and second side surfaces intersecting the board-mounting surface, the first and second side surfaces being formed respectively with first and second mount grooves spaced from the cavities and extending to the board-mounting surface of the housing, each of the mounting grooves having a wide portion substantially adjacent the top surface of the housing and a narrow portion extending from the wide portion to the board mounting surface of the housing;

terminal fittings mounted in the cavities and configured for connection to conductor paths on the circuit board; and first and second board fixing portions made of a metal material each of the board fixing portions having a main plate with opposite top and bottom ends, an upper portion adjacent the top end and being dimensioned for slidable insertion in the wide portion of the mount groove, a middle portion below the upper portion and dimensioned for slidable insertion into the narrow portion of the respective mount groove, biting projections extending out from opposite sides of the middle portion of the main plate and dimensioned for being locked in the narrow portion of the mount groove of the housing, a lower portion between the middle portion and the bottom end of the main plate and being narrower than the middle portion to define solder inflow spaces when the main plate is mounted in the respective mount groove and a leg extending angularly from the bottom end of the main plate, the leg being substantially flush with the board-mounting surface of the housing and having a free end substantially flush with the side surface of the housing at locations substantially adjacent the mount grove for soldered connection of the leg to the circuit board at locations spaced from the terminal fittings without enlarging space requirements on the circuit board for connection of the housing.

6. The circuit board connector of claim 5, wherein each of said mounting grooves has steps between the wide portion and the narrower portion, each of said main plates having steps between the upper portion and the middle portion, the steps of the main plate engaging the steps of the mounting groove to position the respective board fixing portion relative to the board mounting surface.

* * * * *